US010080917B2

(12) United States Patent
Freudinger et al.

(10) Patent No.: US 10,080,917 B2
(45) Date of Patent: Sep. 25, 2018

(54) MOUNTING SYSTEM FOR A PHYSICAL THERAPY DEVICE

(71) Applicants: Bonnie Patricia Freudinger, Greenfield, WI (US); Brian Lorence Laning, Shorewood, WI (US); Lauren Elizabeth Champeau, Milwaukee, WI (US); Heidi Marie Golembiewski, Milwaukee, WI (US)

(72) Inventors: Bonnie Patricia Freudinger, Greenfield, WI (US); Brian Lorence Laning, Shorewood, WI (US); Lauren Elizabeth Champeau, Milwaukee, WI (US); Heidi Marie Golembiewski, Milwaukee, WI (US)

(73) Assignees: Bonnie Patricia Freudinger, Greenfield, WI (US); Brian Lorence Laning, Shorewood, WI (US)

( * ) Notice: Subject to any disclaimer, the term of this patent is extended or adjusted under 35 U.S.C. 154(b) by 0 days.

(21) Appl. No.: 14/691,682

(22) Filed: Apr. 21, 2015

(65) Prior Publication Data

US 2016/0312945 A1 Oct. 27, 2016

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 23/035*** | (2006.01) |
| ***A63B 21/00*** | (2006.01) |

(52) U.S. Cl.

CPC ..... *A63B 21/1645* (2013.01); *A63B 21/0442* (2013.01); *A63B 21/0557* (2013.01); *A63B 21/4023* (2015.10); *A63B 21/4035* (2015.10); *A63B 21/4043* (2015.10); *A63B 23/0355* (2013.01); *A63B 23/03508* (2013.01); *A63B 21/1618* (2013.01); *A63B 21/1663* (2013.01)

(58) Field of Classification Search

USPC ..... 482/139, 120, 93, 121; 211/162, 211/119.004; 248/354.1, 354.3, 354.4

See application file for complete search history.

(56) References Cited

U.S. PATENT DOCUMENTS 2,095,390 A * 10/1937 Lange ..... A63F 9/0204 273/332
2,130,945 A * 9/1938 Brownell ..... G09F 1/10 248/302
2,270,796 A * 1/1942 Hauser ..... A47G 25/08 211/119.004

(Continued)

*Primary Examiner* — Alfred J Wujciak

(74) *Attorney, Agent, or Firm* — Andrus Intellectual Property Law, LLP

(57) ABSTRACT

A mounting system for a physical therapy device that allows the physical therapy device to be anchored at a desired height. The mounting system includes a top bracket and a bottom bracket that each can be received over an edge of a door. A slide rail extends between the top bracket and the bottom bracket. At least one attachment block is received on the slide rail. The attachment block can be moved along the length of the slide rail and includes an attachment ring, or similar device that allows a physical therapy device to be attached to a stationary point. The mounting system can include a second attachment block for providing additional points of attachment for the physical therapy device.

12 Claims, 3 Drawing Sheets

(56) References Cited

U.S. PATENT DOCUMENTS

| | | | | | |
|---|---|---|---|---|---|
| 2,435,382 | A * | 2/1948 | Caskey | B27B 27/04 | 33/32.7 |
| 3,056,507 | A * | 10/1962 | Squires, Jr. | A47B 57/18 | 108/106 |
| 3,618,595 | A * | 11/1971 | Stahmer | A61H 1/02 | 601/26 |
| 5,038,486 | A * | 8/1991 | Ducate, Sr. | B27B 25/10 | 33/430 |
| 6,319,179 | B1 * | 11/2001 | Hinds | A63B 21/0552 | 482/121 |
| 7,178,769 | B2 * | 2/2007 | Magnusson | A47B 96/1416 | 211/119.004 |
| 8,074,583 | B2 * | 12/2011 | Lee | A47B 57/54 | 108/147.13 |
| 8,870,148 | B2 * | 10/2014 | Hickman | A47B 97/04 | 211/119.004 |
| 9,028,381 | B2 * | 5/2015 | Mestemaker | A63B 21/0414 | 482/129 |
| D773,553 | S * | 12/2016 | Hostetler | D17/20 | |
| 2001/0056011 | A1 * | 12/2001 | Endelman | A63B 21/023 | 482/121 |
| 2010/0048368 | A1 * | 2/2010 | Donofrio | A63B 1/00 | 482/130 |
| 2010/0270246 | A1 * | 10/2010 | Rodriguez | A47B 96/16 | 211/34 |
| 2011/0195825 | A1 * | 8/2011 | Liester | A63B 21/018 | 482/120 |
| 2012/0014627 | A1 * | 1/2012 | Rehage | A47B 88/10 | 384/49 |

* cited by examiner

FIG. 2
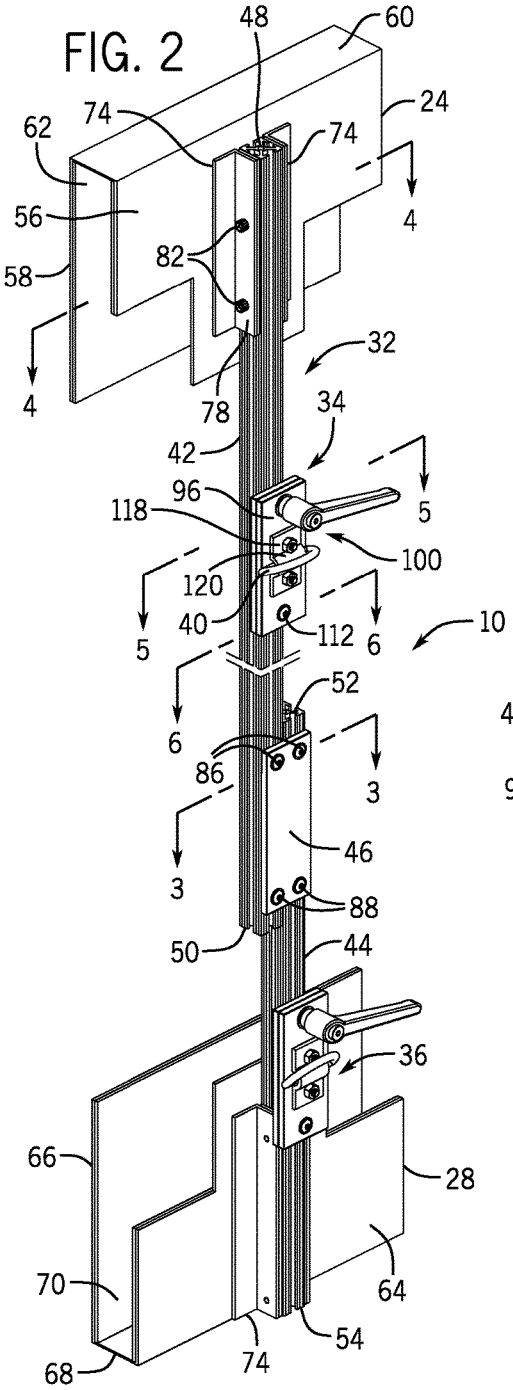
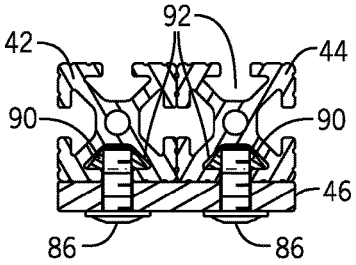
FIG. 3

MOUNTING SYSTEM FOR A PHYSICAL THERAPY DEVICE

BACKGROUND

The present disclosure generally relates to a mounting system for a physical therapy device. More specifically, the present disclosure relates to a mounting system that allows an anchor point for a physical therapy device to be selected and adjusted.

Presently, many different types of physical therapy devices exist that allow a physical therapist to have a patient carry out different types of physical activity/exercises. Often times these physical therapy devices require an anchor point so that the user can exert a physical force against the physical therapy device, such as a resistive hand. In as gym or a physical therapy facility, anchor points are often fixed on a wall, which allows the physical therapist to select between any one of the anchor points. The multiple anchor points allow the physical therapist to tailor the exercises performed by the patient to effectively rehabilitate, many different types of injuries.

However, it is often inconvenient for the patient to travel to the gym a physical therapy facility in order to carry out the exercises prescribed by the physical therapist. Therefore, it would be desirable to provide a mounting system that allows the user to carry out the prescribed exercises either at home or in a less equipped gym or rehabilitation facility.

SUMMARY

The present disclosure relates to a mounting system for a physical therapy device that allows the anchor point of the physical therapy device to be selectively adjusted. The mounting system generally includes a slide rail that extends between a first end and a second end. The slide rail receives at least one attachment block that is moveable along the length of the slide rail. The attachment block includes a point of attachment for the physical therapy device. As one example, the attachment point may be an attachment ring fixed to the attachment block. However, other types of attachment points are contemplated.

The slide rail is connected at a first end to a top attachment device and at a second end to a bottom attachment device. The top and bottom attachment devices are designed to securely support the slide rail within a home or office environment.

In one embodiment of the disclosure, the top attachment device is a top bracket that includes an inner plate and an outer plate spaced from each other to define an upper receiving channel. The bottom attachment device is a bottom bracket that includes a similar inner plate and an outer plate that are spaced from each other to define a bottom receiving channel. The upper receiving channel is configured to be received on a top edge of a door while the bottom receiving channel is configured to be received on a bottom edge of a door.

In one embodiment of the disclosure, the slide rail is formed from at least two separate sections. As an example, the slide rail can include a top slide rail and a bottom slide rail. The top and bottom slide rails overlap each other and are securely joined to each other such that the length of the combined slide rail can be modified to accommodate different sized doors or mounting locations. In one embodiment of the disclosure, the top slide rail and the bottom slide rail are identical extrusions joined to each other by an attachment plate. The attachment plate secures the top and bottom slide rails to each other at a desired length overall length to accommodate the door size. Each of the top and bottom brackets can include a resilient liner formed within the receiving channel to protect the door to which the mounting system is attached.

The mounting system can include either one or a plurality of attachment blocks that are each moveable along the entire length of the slide rail. Each of the attachment blocks includes a hand brake that locks the attachment block in a desired location along the length of the slide rail. The hand brake can be released to allow the attachment block to freely move along, the length of the slide rail to adjust the vertical position of the attachment block. In one embodiment of the disclosure, an inner surface of the attachment block is coated with a wear resistant material to prevent damage during continued use of the attachment block.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 2 is a view similar to FIG. 1 of the mounting system removed from the door;

FIG. 3 is a section view taken along line 3-3 of FIG. 2;

DETAILED DESCRIPTION

Figure 1:
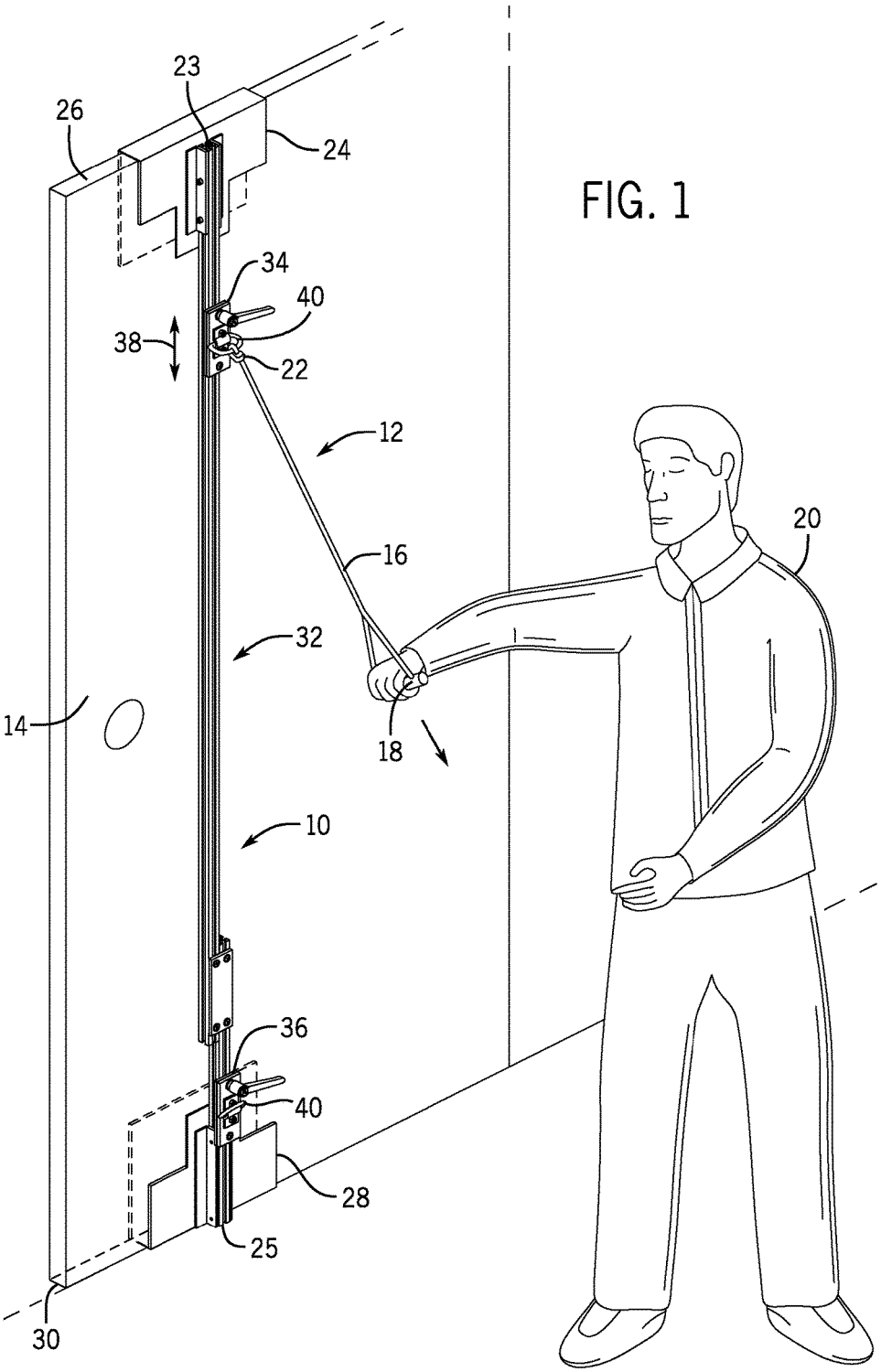
FIG. 1 is a front view of a mounting system for a physical therapy device as installed on a door.

FIG. 1 illustrates a mounting system 10 for anchoring a physical therapy device 12 at a desired height. In FIG. 1, the mounting system is mounted to and supported by a conventional door 14 when the door is in a closed position. However, the mounting system 10 could be configured to attach to other locations or components within a room, such as to a table, counter top, a door jamb or between the floor and ceiling. Additionally, a door wedge (not shown) can be used to secure the door in an open position to allow the mounting system to be used when the door is open.

In the embodiment shown in FIG. 1, the physical therapy device is a resistance band 16 having a handle 18 that is engaged by a user 20 to perform some type of physical activity or exercise movement. Often times, the user 20 will be in the care of a physician or physical therapist and will be required to carry out physical activities/exercises to strengthen and/or rehabilitate an injury. It is desirable that the user 20 can carry out the physical therapy activity in different locations, such as at home or in a therapist facility, to further facilitate the effectiveness of the physical therapy treatment. In the embodiment shown in FIG. 1, the user 20 is performing a shoulder pull utilizing the physical therapy device 12. In such orientation, a second end 22 of the resistance band 16 is anchored to the mounting system at or above shoulder height. However, if the same physical therapy device 12 to be used to perform a leg flex, the anchor point should be located significantly lower than shown. The mounting system 10 of the present disclosure provides a convenient, secure and adjustable anchor point for the second end 22, which allows the user and/or physical therapist to adjust the type of exercise performed.

As can be understood in FIG. 1, the mounting system 10 generally includes a top attachment device that supports a top end 23 of a slide rail 32 and a bottom attachment device that supports a bottom end 25 of the slide rail 32. In the embodiment shown, the top attachment device is a top bracket 24 that is received on the top edge 26 of the door 14 and the bottom attachment device is a bottom bracket 28 that is received on the bottom edge 30 of the door 14. Although in the embodiment shown in FIG. 1, the top attachment device and the bottom attachment device are shown as brackets that are received on a door, it is contemplated that the top and bottom attachment devices could be reconfigured to allow the mounting system to be used with a kitchen counter top, desk or table. As an example, when the mounting system is used with a table, the top attachment device will be a table clamp and the bottom attachment device will be a suction cup or similar component. Additionally, it is contemplated that the mounting system could extend between the floor and ceiling rather than attaching to the door 14. Alternatively, the top attachment device could be used to attach the mounting system to a door jamb instead of directly to the door itself.

The slide rail 32 extends between the top bracket 24 and the bottom bracket 28. The slide rail 32 receives both a first attachment block 34 and a second attachment block 36. The first and second attachment blocks 34, 36 are identical in design such that the description below relative to the attachment block 34 applies to the second attachment block 36. Although only two attachment blocks 34, 36 are shown in the drawings, it should be understood that additional attachment blocks or only a single attachment block 34 could be utilized while operating within the scope of the present disclosure.

As illustrated by arrows 38, the attachment block 34 is moveable along the length of the slide rail 32 to adjust the anchor point for the physical therapy device 12. In the embodiment illustrated, the second end 22 of the resistance band 16 is connected to an attachment ring 40 formed as part of the first attachment block 34. A similar attachment ring. 40 forms part of the second attachment block 36. However, other configurations for the attachment point are contemplated.

Referring now to FIG. 2, in order to accommodate doors having different heights, the slide rail 32 is formed from a top slide rail 42 and a bottom slide rail 44 that are joined to each other by an attachment plate 46. The top slide rail 42 and the bottom slide rail 44 overlap each other. The amount of overlap between the top slide rail 42 and the bottom slide rail 44 can be adjusted to vary the overall length of the slide rail 32 and thus the height of the mounting system 10. It is contemplated that the mounting system 10 can be adjusted to accommodate doors having a height from 78-82 inches. However, the lengths of each of the top and bottom slide rails 42, 44 can be adjusted in order to accommodate doors having an even greater height.

As shown in FIG. 2, a first end 48 of the top slide rail 42 is securely connected to the top bracket 24 while the second end 50 is generally aligned with the bottom slide rail 44. Likewise, a first end 52 of the bottom slide rail 44 is aligned with the top slide rail 42 while the second end 54 is connected to the bottom bracket 28.

The top bracket 24 includes an inner plate 56 and art outer plate 58 joined to each other by a connecting wall 60. The inner plate 56, outer plate 58 and connecting wall 60 combine to define a top receiving channel 62. In the same manner, the bottom bracket 28 includes an inner plate 64, an outer plate 66 and a connecting wall 68 that combine to define an open bottom receiving channel 70. Both the top receiving channel 62 and the bottom receiving channel 70 are sized such that the brackets can be received over doors having a thickness of up to 1.6875 inches. However, it should be understood that each of the top and bottom brackets 24, 28 could be designed to accommodate doors having greater thickness. In the embodiment illustrated, each of the top and bottom brackets 24, 28 are formed from a metallic material. However, it is contemplated that the top and bottom brackets could be formed from plastic, carbon fiber or another similar material while operating within the scope of the present disclosure.

Figure 4:
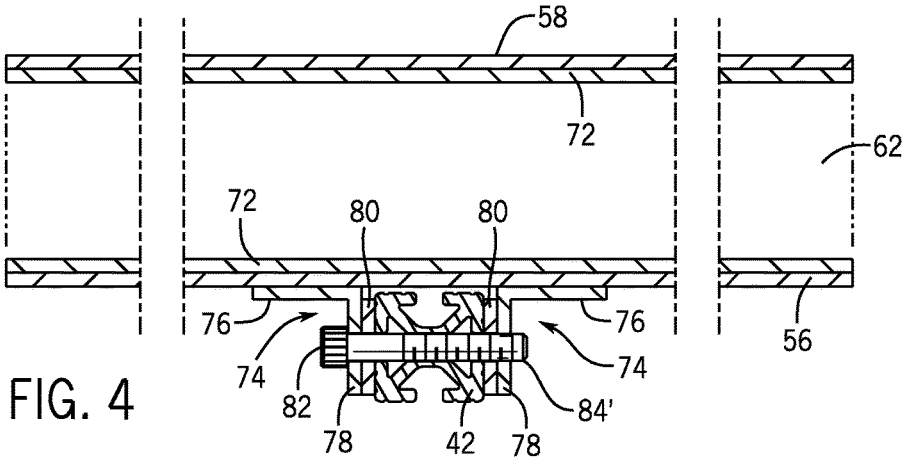
FIG. 4 is a section view taken along line 44 of FIG. 2.

Referring now to FIG. 4, the top receiving channel 62 is shown between the inner plate 56 and the outer plate 58. In the embodiment shown, a layer of foam 72 or other similar resilient material is connected to the inner surface of both the inner plate 56 and the outer plate 58 to prevent damage to the door when the top and bottom brackets are installed. The layer of foam 72 is resilient and flexes to accommodate doors having different thicknesses.

Referring back to FIGS. 2 and 4, the top bracket 24 is connected to the first end 48 of the top slide rail 42 by a pair of L-shaped brackets 74. Each of the L-shaped brackets 74 includes a first leg 76 attached to the inner plate 56 and a second leg 78. The pair of legs 78 are spaced by a distance to accommodate the top slide rail 42. In the embodiment shown in FIG. 4, a pair of spacers 80 are positioned between each of the legs 78 and an outer surface of the top slide rail 42.

As shown in FIGS. 2 and 4, a pair of connectors 82 pass through the L-shaped brackets 74 to securely attach the top bracket 24 to the top slide rail 42. In the embodiment shown, each of the connectors 82 includes a threaded shaft 84. The bottom bracket 28 includes a similar pair of L-shaped brackets 74 that are used to connect the bottom bracket 28 to the second end 54 of the bottom slide rail 44.

Referring now to FIGS. 2 and 3, during the installation process, the bottom bracket 28 is installed over the bottom edge 30 of the door while the top bracket 24 is installed over the top edge 26 of the same door. Once in this position, the top slide rail 42 will overlap the bottom slide rail 44 such that the mounting system 10 can be used with doors having various heights. Once the top and bottom brackets are installed, the attachment plate 46 is used to join the top slide rail 42 to the bottom slide rail 44. As shown in FIG. 2, the attachment plate 46 receives a pair of upper connectors 86 and a pair of lower connectors 88. As can be understood in FIG. 3 the right connector 86 passes through the attachment plate 46 and is received by a block 90 contained within a receiving slot 92 formed as part of the bottom slide rail 44. The left connector 86 is received within a block 90 formed in a similar receiving slot 92 of the top slide rail 42.

As illustrated in the section view of FIG. 3, both the top slide rail 42 and the bottom slide rail 44 are formed from the same extrusion and have four separate receiving slots 92 that extend along the entire length of the respective top and bottom slide rails. The block 90 is moveable along the entire length of the slide rail and, when the threaded connector 86 is tightened, the block 90 moves against the extrusion to securely attach the attachment plate 46 between the top slide rail 42 and the bottom slide rail 44. Although a specific extrusion is shown, it is contemplated that other extrusion shapes could be used.

Figure 5:
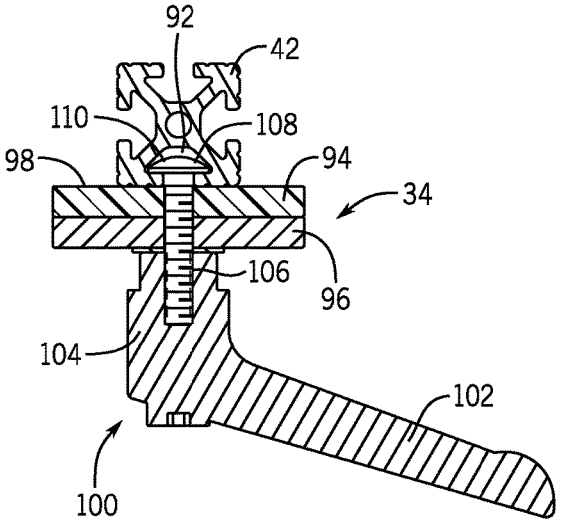
FIG. 5 is a section view taken along line 5-5 of FIG. 2.

Referring now to FIGS. 2 and 5, the first attachment block 34 is selectively moveable along the length of the top slide rail 42 while the second attachment block 36 is moveable along the shorter length of the bottom slide rail 44. The first attachment block 34 includes an inner slide plate 94 and an outer slide plate 96 joined to each other. The inner slide plate 94 includes an inner surface 98 that slides along the extrusion that forms the top slide rail 42. In one embodiment of the disclosure, at least the inner surface 98 of the inner slide plate 94 includes a wear resistant material, such as a PTFE-based formula, such as Teflon. The wear resistant coating formed on the inner slide plate 94 reduces wear on the inner slide plate 94 during continuous use.

The first attachment block 34 includes a hand brake 100 that can be manipulated by the user to lock the attachment block 34 in a desired location along the length of the top slide rail 42. The hand brake 100 includes a handle portion 102 that extends from a barrel portion 104. The barrel portion 104 includes the threaded shaft 106 of the connector 108. Connector 108 includes an expanded head portion 110 that is received within the receiving slot 92. When the handle portion 102 is rotated a quarter turn, the threaded shaft 106 causes the head portion 110 to engage the outer edges of the receiving slot 92 to lock, the first attachment block 34 in a desired position. When the user desires to release the attachment block 34, the handle portion 102 is rotated in the opposite direction to release the head 110.

Figure 6:
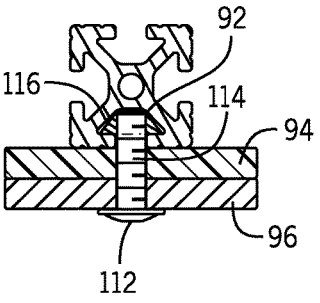
FIG. 6 is a section view taken along line 6-6 of FIG. 2.

As shown in FIGS. 2 and 6, each of the attachment blocks 34 includes a second connector 112 that passes through both the outer slide plate 96 and the inner slide plate 94. The threaded shaft 114 is received within a block 116 that is freely moveable within the receiving slot 92. A combination of the second connector 112 and the block 116 prevents the lower end of first attachment block 34 from becoming disengaged from the top slide rail 42. As discussed previously, the second attachment block 36 is constructed in an identical manner to the first attachment block 34.

As shown in FIG. 2, the first attachment block 34 includes an attachment ring 40 secured to the outer slide plate 96 by a ring bracket 118 having an extending center section 120. The center section 120 allows the ring 40 to move relative to the outer slide plate 96. Although the attachment ring 40 is shown as the point of attachment for the physical therapy device, it should be understood that the ring 40 could be replaced with various other different types of attachment devices that would allow the physical therapy device to be anchored to the slide rail. Each of these different types of attachment devices could be connected to the outer slide plate 96 in conventional, known manners.

As can be understood in FIG. 2, the range of travel far the first attachment block 34 is limited by the attachment plate 46 while the range of travel of the second attachment block 36 is also limited by the same attachment plate 46. The use of the two attachment blocks 34, 36 allows physical therapy devices to be attached to the mourning system 10 anywhere between the first end 48 of the top slide rail 42 and the second end 54 of the lower slide rail 44 except for at the location of the attachment plate 46. In this manner, a therapist can design various different types of physical therapy activities utilizing the entire height of the mounting system 10. Further, the mounting system 10 can be mounted at various different locations within a physical therapist's office, at the home of the user 20 or at any other location having a door.

In one alternate, contemplated design, the mounting system 10 of the present disclosure could include different attachment devices such that the mounting system could attach to a kitchen countertop, desk or table. In such an embodiment, the top attachment device could be replaced by a table clamp while the bottom attachment device could be replaced by a suction cup. In such an embodiment, the mounting system would allow the physical therapy device to be securely anchored between the kitchen countertop, desk or table and the floor.

In yet another contemplated embodiment, the mounting system 10 could be configured such that the mounting system would include telescoping poles that would extend into contact with both the floor and ceiling. In such an embodiment, the mounting system could be used anywhere within a room and would provide an anchor point for the physical therapy device.

In yet another contemplated embodiment, the mounting system could attach to a door handle rather than the top edge of the door. The top attachment device would allow for such attachment to the door handle while the bottom attachment device could attach to either the floor or the bottom edge of the door.

In the embodiment shown in FIG. 1, the door 14 is shown in the closed position. However, it is contemplated that a door wedge could be utilized to secure the door in an open position to allow for further range of use of the mounting system.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A door mount for a physical therapy device, comprising:

a top bracket and a bottom bracket wherein the top bracket includes a top receiving channel and the bottom bracket includes a bottom receiving channel, wherein the top receiving channel and the bottom receiving channel are sized to receive a door, a slide rail extending between a first end and a second end, wherein the slide rail includes a top slide rail having a first end connected to the top bracket and a second end, and a bottom slide rail having a first end and a second end connected to the bottom bracket, wherein the second end of top slide rail is slidable mounted along the length of the bottom slide rail combined length of the top slide rail and the bottom slide rail to be adjustable; and a first attachment block mounted for sliding movement along the length of the slide rail, the first attachment block providing a point of attachment for the physical therapy device.

2. The mounting system of claim 1 wherein the first attachment block includes a hand brake operable to lock the attachment block at a desired location along the length of the receiving slot of the slide rail.

3. The mounting system of claim 1 wherein the first attachment block includes an inner slide plate and an outer slide plate, wherein the inner slide plate contacts and moves along an outer surface of the slide rail and the outer slide plate includes a connection point for the physical therapy device.

4. The mounting system of claim 3 wherein the inner slide plate includes a Teflon coating.

5. The mounting system of claim 3 further comprising an attachment ring secured to the outer slide plate.

6. The mounting system of claim 1 wherein the top slide rail and the bottom slide rail are joined to each other by an attachment plate.

7. The mounting system of claim 1 further comprising a second attachment block, wherein the second attachment block is moveable along the bottom slide rail.

8. The mounting system of claim 7 wherein both the first attachment block and the second attachment block include a hand brake operable to lock the first and second attachment blocks along the length of the top slide rail and the bottom slide rail.

9. The mounting system of claim 7 wherein the first attachment block and the second attachment block each include an inner slide plate and an outer slide plate, wherein the inner slide plate contacts the slide rail and the outer slide plate provides a point of connection for the physical therapy device.

10. The mounting system of claim 9 wherein the inner slide plate includes a Teflon coating.

11. The mounting system of claim 1 further comprising a resilient liner formed within the top receiving channel of the top bracket and the bottom receiving channel of the bottom bracket.

12. The mounting system of claim 1 wherein the top bracket includes an inner plate and an outer plate spaced from each other to define the top receiving channel and the bottom bracket includes an inner plate and an outer plate spaced from each other to define the bottom receiving channel.

* * * * *